US011047652B2

(12) United States Patent
Cole

(10) Patent No.: US 11,047,652 B2
(45) Date of Patent: Jun. 29, 2021

(54) TARGET ASSEMBLY WITH STOWED POSITION AND DEPLOYED POSITION

(71) Applicant: COLE ENERGY MERCHANDISING LLC, Plainfield, IN (US)

(72) Inventor: Jesse N. Cole, Clayton, IN (US)

(73) Assignee: COLE ENERGY MERCHANDISING LLC, Plainfield, IN (US)

( * ) Notice: Subject to any disclaimer, the term of this patent is extended or adjusted under 35 U.S.C. 154(b) by 0 days.

(21) Appl. No.: 16/861,730

(22) Filed: Apr. 29, 2020

(65) Prior Publication Data

US 2020/0363170 A1 Nov. 19, 2020

Related U.S. Application Data

(60) Provisional application No. 62/849,156, filed on May 17, 2019.

(51) Int. Cl.

| | |
|---|---|
| ***F41J 1/10*** | (2006.01) |
| *F41J 1/01* | (2006.01) |
| *F41J 7/04* | (2006.01) |

(52) U.S. Cl.

CPC .. *F41J 1/10* (2013.01); *F41J 1/01* (2013.01); *F41J 7/04* (2013.01)

(58) Field of Classification Search

CPC ..... F41J 1/10; F41J 7/04

See application file for complete search history.

(56) References Cited

U.S. PATENT DOCUMENTS

| | | | | |
|---|---|---|---|---|
| 3,355,174 | A * | 11/1967 | Hutson | F41J 1/10 273/408 |
| 3,583,466 | A * | 6/1971 | Dreyer | G03B 21/58 160/351 |
| 6,491,303 | B1 * | 12/2002 | Huston | F41J 1/10 273/407 |
| 8,172,231 | B2 * | 5/2012 | Massier | F41J 9/02 273/406 |
| 9,689,647 | B1 * | 6/2017 | Dolgoff | F16B 47/003 |
| 10,357,675 | B1 * | 7/2019 | Katz | F16B 19/109 |
| 10,495,423 | B2 * | 12/2019 | Burks | F41J 1/10 |
| 10,502,535 | B2 * | 12/2019 | Sun | F41J 7/04 |
| 10,634,464 | B2 * | 4/2020 | Babcock | F41J 1/10 |
| 2011/0127723 | A1 * | 6/2011 | Haynes | F41J 1/10 273/407 |
| 2014/0232067 | A1 * | 8/2014 | Barry | F41J 1/10 273/392 |

* cited by examiner

*Primary Examiner* — Laura Davison

(74) *Attorney, Agent, or Firm* — Taft Stettinius & Hollister LLP; William Michael Etienne

(57) ABSTRACT

A target assembly configured to be assembled in a stowed position and a deployed position includes a main frame, first and second support legs removably coupled to the main frame in the stowed and deployed positions, and first and second platform bases removably coupled to the support legs in the stowed and deployed positions. In the stowed position the first and second support legs and first and second platform bases are positioned within a footprint of main frame.

17 Claims, 9 Drawing Sheets

TARGET ASSEMBLY WITH STOWED POSITION AND DEPLOYED POSITION

RELATED APPLICATIONS

This application claims priority to Provisional Application No. 62/849,156, filed May 17, 2019.

FIELD OF THE DISCLOSURE

The present application relates to a target assembly, and more particularly to a target assembly movable between a deployed position to be fired at and a stowed position for transportation and/or storage.

BACKGROUND

As with any skill in life, marksmanship takes practice to learn, improve, and become comfortable with using firearms. There are several locations where an individual can practice, such as indoor or outdoor shooting ranges or on private property. There are also several styles of targets, made with several different kinds of material, that an individual can utilize to hone their skills. In order to experience these different target styles and materials, an individual would be required to have access to all of them personally or go to a range that provides them. This requirement can be a difficult, time-consuming, and/or costly process.

What is needed, therefore, is a design to overcome many of the disadvantages of prior target systems. For example, what is needed is a portable, durable, easy-to-assembly target design that allows for diverse training or entertainment session regardless of location or skill level.

SUMMARY

In an illustrative embodiment of the disclosure, a target assembly configured to be assembled in a stowed position and in a deployed position comprises a main frame including: a first side panel having a first end and a second end, a second side panel having a first end and a second end, a top panel coupled to the first ends of the first and second side panels, and a bottom panel coupled to the seconds ends of the first and second side panels; a first support leg and a second support leg each removably coupled to the main frame when the target assembly is in the stowed position and the deployed position; a first platform base removably coupled to the first support leg when the target assembly is in the stowed position and the deployed position, the first platform base including: a first foot extending from a first end to a second end and configured to rest on a ground surface, and a first sleeve coupled to and extending substantially perpendicular to the first foot; a second platform base removably coupled to the second support leg when the target assembly is in the stowed position and the deployed position, the second platform base including: a second foot extending from a first end to a second end and configured to rest on a ground surface, and a second sleeve coupled to and extending substantially perpendicular to the second foot; wherein: (i) in the stowed position the first support leg, second support leg, first platform base, and second platform base are positioned within the main frame, and (ii) in the deployed position the first support leg, second support leg, first platform base, and second platform base are positioned outside the main frame; wherein: (i) in the stowed position the first support leg is removably coupled to the first side panel of the main frame and the second support leg is removably coupled to the second side panel of the main frame, and (ii) in the deployed position the first and second support legs are each removably coupled to the bottom panel of the main frame.

In some embodiments, (i) in the stowed position the first support leg is removably coupled to the first foot of the first platform base, and (ii) in the deployed position the first support leg is removably coupled to the first sleeve of the first platform base; and (i) in the stowed position the second support leg is removably coupled to the second foot of the second platform base, and (ii) in the deployed position the second support leg is removably coupled to the second sleeve of the second platform base.

In some embodiments, the target assembly includes a first fastener and a second fastener; (i) the first support leg includes a first end and a second end, (ii) the first end of the first support leg includes a first aperture extending therethrough, (iii) the first fastener extends through the first aperture to removably couple to the first support leg to the first foot when the target assembly is in the stowed position, and (iv) the first fastener extends through the first aperture to removably couple the first support leg to the first sleeve when the target assembly is in the deployed position; and (i) the second support leg includes a first end and a second end, (ii) the first end of the second support leg includes an second aperture extending therethrough, (iii) the second fastener extends through the second aperture to removably couple the second support leg to the second foot when the target assembly is in the stowed position, and (iv) the second fastener extends through the second aperture to removably couple the second support leg to the second sleeve when the target assembly is in the deployed position.

In some embodiments, the target assembly further comprises a first fastener and a second fastener; in the stowed position the first fastener extends through and removably couples the first side panel, the first support leg, and first platform base; and in the stowed position the second fastener extends through and removably couples the second side panel, the second support leg, and second platform base.

In another illustrative embodiment, a target assembly configured to be assembled in a stowed position and a deployed position includes: a main frame including: a first side panel having a first end and a second end, a second side panel having a first end and a second end, a top panel coupled to the first ends of the first and second side panels, and a bottom panel coupled to the seconds ends of the first and second side panels; a first support leg and a second support leg each removably coupled to the main frame when the target assembly is in the stowed position and the deployed position; a first platform base removably coupled to the first support leg when the target assembly is in the stowed position and the deployed position, the first platform base including: a first foot extending from a first end to a second end, and a first beam coupled to the first foot; a second platform base removably coupled to the second support leg when the target assembly is in the stowed position and the deployed position, the second platform base including: a second foot extending from a first end to a second end, and a second beam coupled to the second foot; wherein in the stowed position the first support leg, second support leg, first platform base, and second platform base are positioned within the main frame. In some embodiments, in the deployed position the first support leg, second support leg, first platform base, and second platform base are positioned outside the main frame.

In some embodiments, (i) in the stowed position the first support leg is removably coupled to the first foot of the first platform base, and (ii) in the deployed position the first support leg is removably coupled to the first beam of the first platform base; and wherein: (i) in the stowed position the second support leg is removably coupled to the second foot of the second platform base, and (ii) in the deployed position the second support leg is removably coupled to the second beam of the second platform base.

In some embodiments, (i) in the stowed position the first support leg is removably coupled to the first side panel of the main frame and the second support leg is removably coupled to the second side panel of the main frame, and (ii) in the deployed position the first and second support legs are each removably coupled to the bottom panel of the main frame.

In some embodiments, the target assembly further comprises a first fastener and a second leg fastener, in the stowed position the first leg fastener removably couples the first support leg and first platform base to the main frame, and in the stowed position the second fastener removably couples the second support leg and second platform base to the main frame.

In some embodiments, the target assembly further includes: a bracket assembly including and a first hanger and a second hanger each coupled to and extending downward from the top panel; a support rod supported above the ground by the first and second hangers; and a swinging target assembly including a mount arm coupled to the support rod and a plate coupled to the mount arm; wherein the swinging target assembly is rotatable relative to the main frame.

In some embodiments, when the target assembly is in the stowed position at least one of the first beam and the second beam limits rotation of the swinging target assembly.

In some embodiments, the target assembly further comprises a clay target; wherein the top panel includes a slot sized to receive the clay target and support the clay target in an upright position. The slot is defined between the first hanger and the second hanger.

In some embodiments, the bracket assembly is a first bracket assembly of a plurality of bracket assemblies; the swinging target assembly is a first swinging target assembly of a plurality of swinging target assemblies; the first swinging target assembly is positioned between the first and second hanger of the first bracket assembly; and a second swinging target assembly of the plurality of swinging target assemblies is positioned between the second hanger of the first bracket assembly and a first hanger of a second bracket assembly of the plurality of bracket assemblies.

In some embodiments, the target assembly further comprises a plurality of clay targets; the top panel includes a plurality of slots each defined between the first and second hangers of different bracket assemblies included in the plurality of bracket assemblies; and each of the plurality slots is sized to receive and support one of the plurality of clay targets in an upright position.

In some embodiments, the bottom panel includes a plurality of slots each sized to receive a clay target and support the clay target in an upright position; and the plurality of slots defined in the bottom panel are aligned with the plurality of slots defined in the top panel.

In some embodiments, the target assembly further comprises a first fastener and a second fastener; the first and second beams each include a plurality of apertures; and the first and second fasteners are configured to be inserted in various apertures of the plurality of aperture to adjust the height of the main frame when the target assembly is in the deployed position.

In some embodiments, the target assembly further comprises a first fastener and a second fastener; the first beam includes a first aperture configured to receive the first fastener when the target assembly in is the deployed position and the second leg includes a second aperture configured to receive the second fastener when the target assembly in is the deployed position; and the first side panel includes a third aperture configured to receive the first fastener when the target assembly is in the stowed position and the second side panel includes a fourth aperture configured to receive the second fastener when the target assembly is in the stowed position.

In some embodiments, the target assembly includes a plurality of target-holding cylinders each coupled to the first or second side panel of the main frame; and a plurality of rotating targets each rotatably coupled to one of the plurality of target-holding cylinders.

In another illustrative embodiment, a method of moving a target assembly between a stowed position and a deployed position includes: positioning a platform base of the target assembly on a ground surface; coupling a first end of a support leg to a main frame of the target assembly and coupling a second end of the support leg to the platform base to move the target assembly to the deployed position; removing a first fastener from the support leg to decouple the support leg from the main frame or the platform base; inserting the first fastener into: (i) an aperture formed in the main frame, (ii) an aperture formed in the support leg, and (iii) an aperture formed in the platform base to provide a three way coupling between the main frame, the support leg, and the platform base when the target assembly is in the stowed position.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
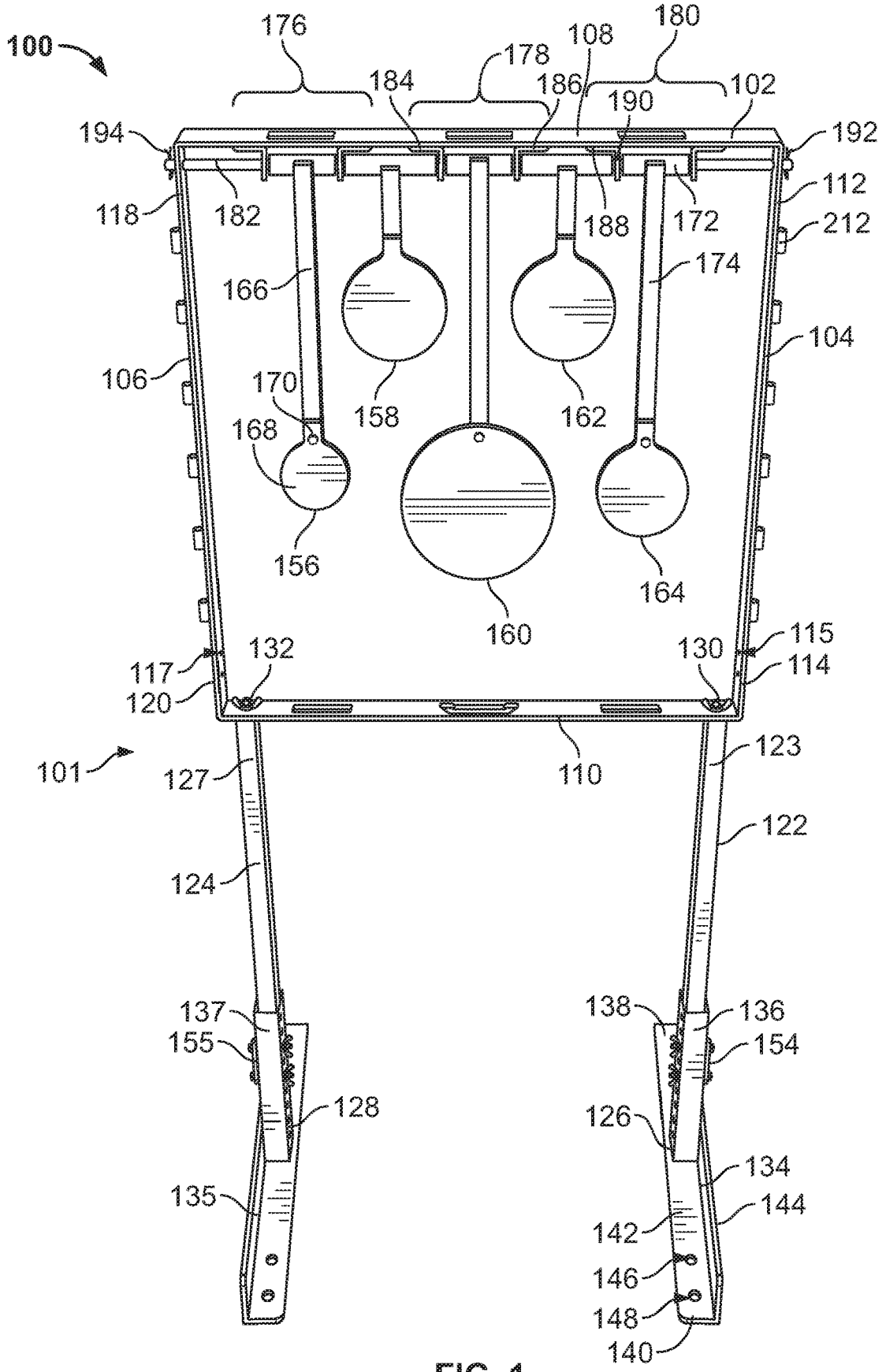
FIG. 1 is a perspective view of a target assembly in a deployed position.
Figure 5:
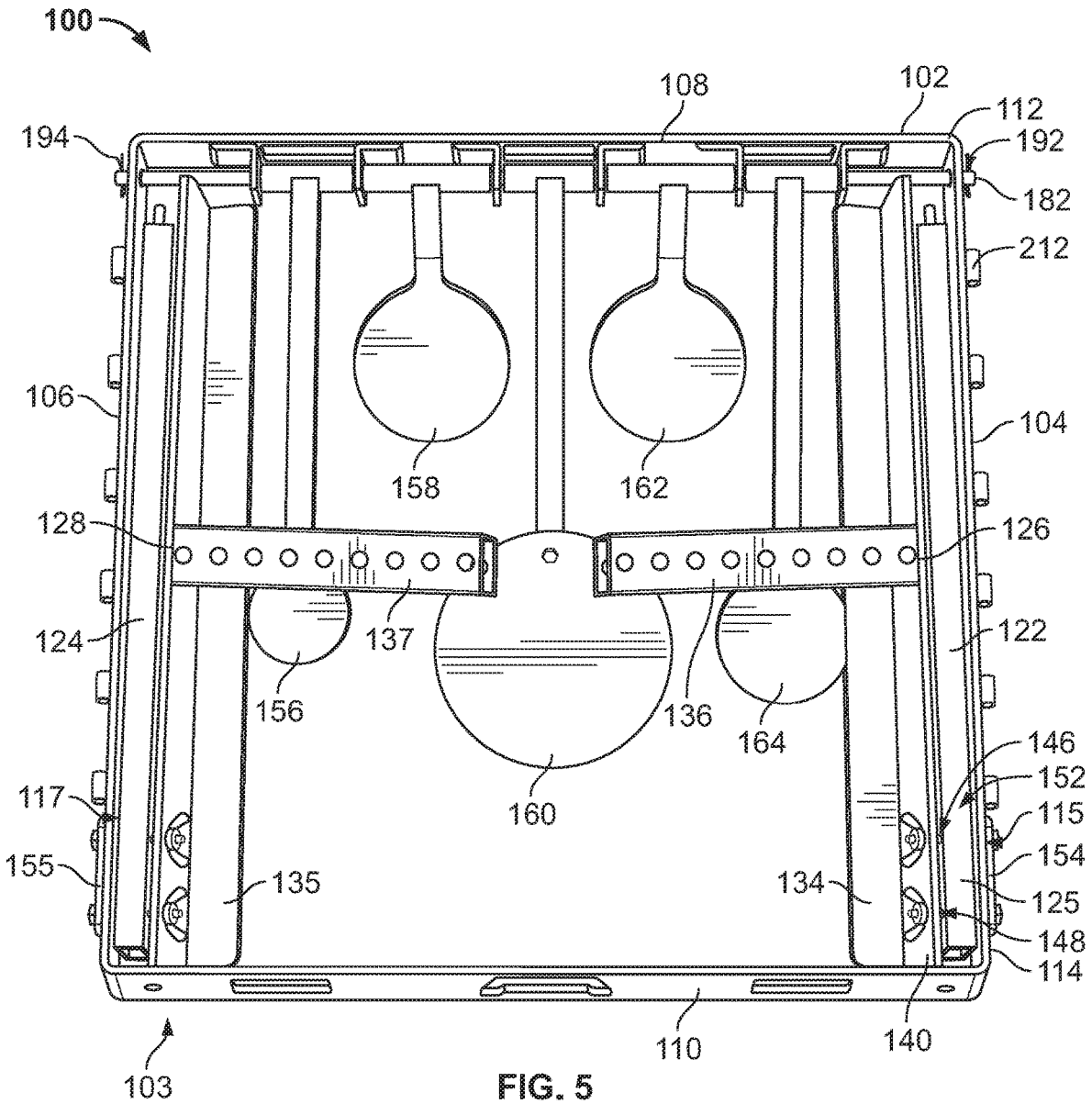
FIG. 5 is a perspective view of the target assembly of FIG. 1 in a stowed position.

FIG. 1 illustrates a target assembly 100, which is movable from a deployed 101 position shown in FIG. 1 to a stowed position 103 shown in FIG. 5. The target assembly 100 may also be referred to as a multiple shooting target holder platform. The target assembly 100 includes a main target body or main frame 102 comprising a pair of side panels 104, 106 coupled to a top panel 108 and a bottom panel 110. In the illustrative embodiment, the first side panel 104 includes a top end 112 and a bottom end 114. The second side panel 106 includes a top end 118 and a bottom end 120. The top panel 108 is coupled to the top ends 112, 118 of the first and second side panels 104, 106, and the bottom panel 110 is coupled to the bottom ends 114, 120 of the first and second side panels 104, 106.

The bottom ends 114, 120 of the first and second side panels 104, 106 each include at least one aperture 115, 117 respectively. In the illustrative embodiment, the at least one apertures 115, 117 each comprise two apertures each configured to receive a dual-fastener fastening mechanism 154 or 155, as will be described in greater detail below.

The target assembly 100 also includes a pair of support legs 122, 124, which may be referred to as support members, and a pair of platform bases 126, 128, which may be referred to as platform members. The first support leg 122 and the second support leg 124 are each removably coupled to the bottom panel 110 of the main target body 102 when the target assembly 100 is in the deployed position 101, as shown in FIG. 1.

The first support leg 122 is coupled, at a first end 123 thereof, to the bottom panel 110. The second support leg 124 is coupled, at a first end 127 thereof, to the bottom panel 110 as well. In the illustrative embodiment, a first fastener 130 couples the first support leg 122 to the bottom panel 110, and a second fastener 132 coupled the second support leg 124 to the bottom panel 110. The first and second fasteners 130, 132 may be referred to as support member hardware. While in the illustrative embodiment, the first and second fasteners 130, 132 are threads extending from the first ends 123, 127 and wingnuts threadingly coupled thereto, it should be appreciated that other fasteners and fastening mechanisms may be used instead. For example, in some embodiments, a snap-fit assembly may be used to couple the support legs 122, 124 to the main frame 102.

Referring still to FIG. 1, the first platform base 126 is removably coupled to the first support leg 122, and the second platform base 128 is removably coupled to the second support leg 124 when the target assembly 102 is in the deployed position 101. The first platform base 126 includes a first foot 134 and a first beam 136 coupled to the first foot 134, and the second platform base 128 includes a second foot 135 and a second beam 137 coupled to the second foot 135. It should be appreciated that the first support leg 122 and the second support leg 124 are oriented as mirror images of one another and are otherwise identical such that any description of the first support leg 122 applies equally to the second support leg 124 and any mirror-image fasteners coupled thereto. The same is true of the first platform base 126 and the second platform base 128 and any mirror-image fasteners coupled thereto. The same is true of the first panel 104 of the main frame and the second panel 106 of the main frame 102 and any mirror-image fasteners coupled thereto.

The first foot 134 extends from a first end 138 to a second end 140 and is configured to rest on a ground surface to support the target assembly 100 upright when the target assembly 100 is in the deployed position 101. In the illustrative embodiment, the first foot 134 includes a ground-engaging panel 142 and a support panel 144 coupled to and extending upward from the ground-engaging panel 142. The ground engaging panel 142 includes at least one, and in the illustrative embodiment, two apertures 146, 148 formed in the second end 140 of the foot 134. Stakes or pins (not shown) may be inserted into the apertures 146, 148 to stabilize the target assembly 100 upright in the deployed position 101. The first beam 136 extends upward and substantially perpendicular to the first foot 134 when the target assembly 100 is in the deployed position 101. In the illustrative embodiment, first beam 136 is welded to one or both panels 142, 144 of the first foot 134; however, other structures for coupling the components are also contemplated by this disclosure. For example, the foot 134 may include another beam having a smaller cross-section over which the first beam 136 is positioned. The another beam may be referred to as a stub at times herein.

Figure 2:
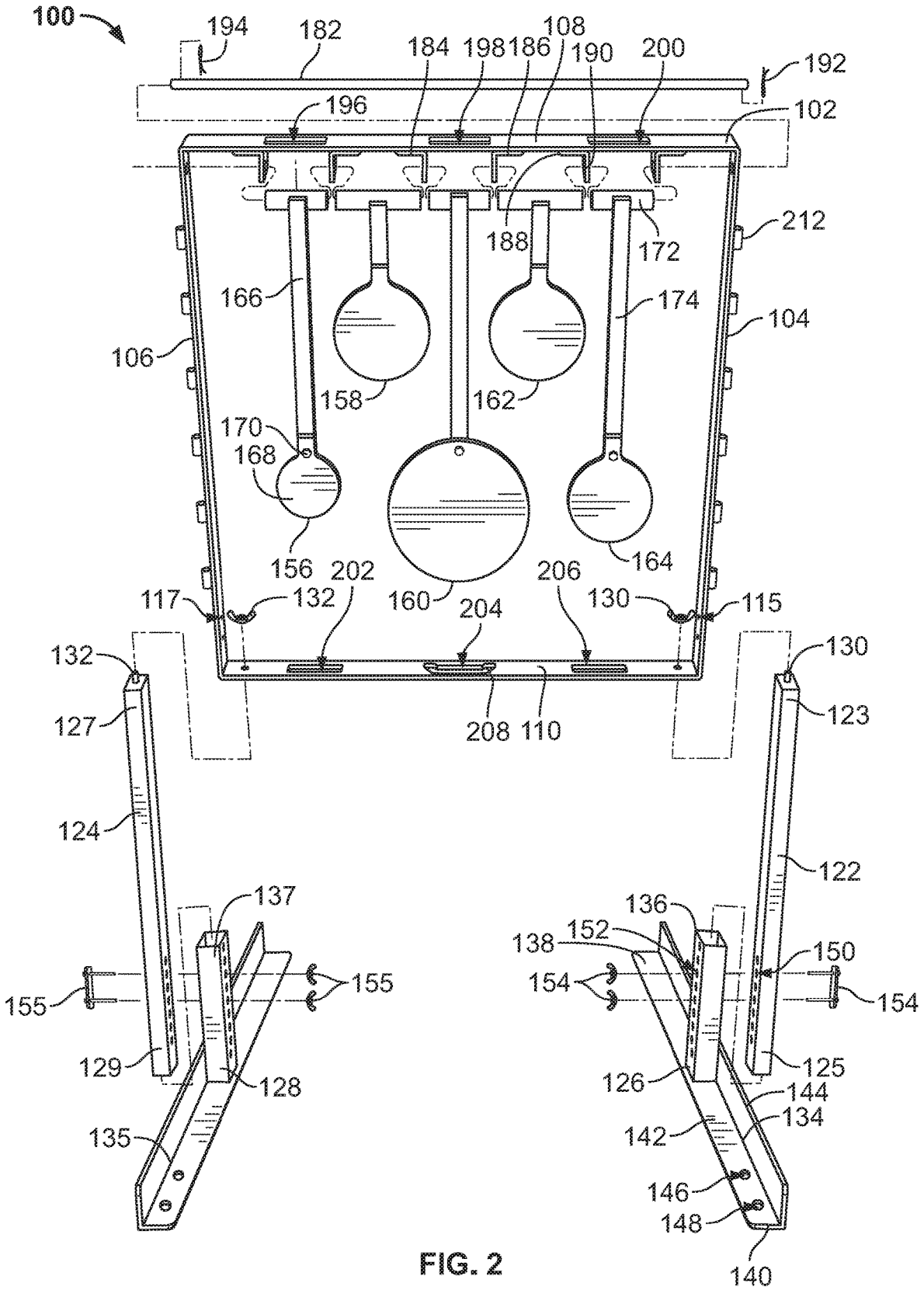
FIG. 2 is an exploded perspective view of the target assembly of FIG. 1.

In the illustrative embodiment, the beam 136 is a first sleeve which may be coupled to the foot 134 as described above. The first sleeve 136 is formed to include a hollow portion configured to receive a second end 125 of the first support leg 122. As best shown in FIG. 2, the first support leg 122 includes at least one aperture 150 defined in the second end 125 of the support leg 122. The at least one aperture 150 is configured to be aligned with at least aperture defined in the first sleeve 136. The fastener 154 couples the first support leg 122 to the sleeve 136. The fastener 154 may be referred to as platform member hardware. While in the illustrative embodiment the fastener 154 is a wingnut screw and a screw configured to be threadingly coupled, it should be appreciated that other fasteners and fastening mechanisms may be used instead. For example, is some embodiments, a snap-fit assembly may be used to couple the support leg 122 to the first beam 136.

In the illustrative embodiment, the fastener 154 includes two screws coupled together by a strut and two wingnuts configured to threadingly couple to the screws. Accordingly, the sleeve 136 includes at least two apertures, one to receive each screw. In the illustrative embodiment, the aperture 152 is one of a series of vertically aligned apertures formed in the sleeve 136, and the aperture 150 is one of a series of vertically aligned apertures formed in the support leg 122. Various apertures in the respective series may be aligned with one another to adjust the height of the target assembly 100 in the deployed position 101. As suggested in FIG. 2, the second support leg 124 is also adjustable relative to the beam 137 and fastenable to the beam 137 to move the target assembly 100 to the deployed position.

As shown in FIGS. 1 and 2, the target assembly 100 further includes a plurality of swinging targets including, for example, swinging targets 156, 158, 160, 162, and 164. Each swinging target is configured to rotate or swing forward and rearward relative to the main frame 102 of the target assembly 100. Each swinging target 156, 158, 160, 162, 164 includes a mount arm 166 removably coupled to a plate 168 via a fastener 170. The fastener 170 may be loosened, and the plate 168 may be removed from the mount arm 166. A different plate 168 may be coupled to the mount arm 166 using the same fastener 170. In this way, any plate 168 of the swinging targets 156, 158, 160, 162, 164 is interchangeable with every other plate 168. Similarly, a new plate (not shown), may be coupled to the mount arm 166 with the same fastener 170 to provide a fully customizable target assembly 100.

In the illustrative embodiment, each mount arm 166 includes a horizontal arm 172 and a vertical arm 174. The horizontal arm 172 is a hollow cylinder. The vertical arm 174 extends perpendicular to the horizontal arm 172 and includes a first end coupled to the horizontal arm 172 and a second end coupled to the plate 168 via the fastener 170. The swinging targets 156, 158, 160, 162, 164 are coupled to the main frame 102 via a plurality of bracket assemblies 176, 178, 180 and a support rod 182. Each bracket assembly 176, 178, 180 includes a first hanger 184 and a second hanger 186. Each hanger 184, 186 includes a first portion 188 coupled to the top panel 108 of the main frame 102 and a second portion 190 extending from the first portion 188 toward the bottom panel 110 of the main frame 102. The second portion 190 of each hanger 184, 186 includes an aperture formed therein that is aligned with apertures formed in the first side panel 104 and the second side panel 106.

As shown in FIG. 1 and suggested by FIG. 2, the support rod 182 may be inserted through: (i) the aperture formed in the first side panel 104, (ii) the apertures formed in the second portion 190 of each hanger 184, 186, (iii) each horizontal arm 172, and (iv) the aperture formed in the second side panel 106. Pins 192, 194 may be coupled to the support rod 182 to maintain the support rod 182 in its location within the apertures. In this arrangement, the swinging targets 156, 158, 160, 162, 164 are supported by the support rod 182, and the support rod 182 facilitates rotation of the swinging targets 156, 158, 160, 162, 164 relative to the main frame 102.

It should be appreciated that the swinging targets 156, 160, 164 are positioned between the hangers 184, 186 of bracket assemblies 176, 178, 180 respectively; the swinging target 158 is positioned between the second hanger 186 of bracket assembly 176 and the first hanger 184 of bracket assembly 178; and the swinging target 162 is positioned between the second hanger 186 of bracket assembly 178 and the first hanger 184 of bracket assembly 180. In some embodiments, each swinging target 156, 158, 160, 162, 164 is interchangeable with every other swinging target 156, 158, 160, 162, 164 along the support rod 182.

Referring now to FIG. 2, the top panel 108 and the bottom panel 110 of the main frame 102 each include a plurality of slots. For example the top panel 108 includes: a first slot 196 positioned between the first and second hangers 184, 186 of the first bracket assembly 176, a second slot 198 positioned between the first and second hangers 184, 186 of the second bracket assembly 178, and a third slot 200 positioned between the first and second hangers 184, 186 of the third bracket assembly 180. The bottom panel 110 includes, for example, a first slot 202, a second slot 204, and a third slot 206, which are aligned respectively with slots 196, 198, 200. Each slot 196, 198, 200, 202, 204, 206 may include a grommet 208 positioned around the perimeter of the slot. The grommet 208 may be rubberized material or other material sufficient to prevent breakage of an object positioned in the slot. In the FIG. 2, a rubberized grommet 208 is illustratively positioned in the slot 204 formed in the bottom panel 110.

Figure 3:
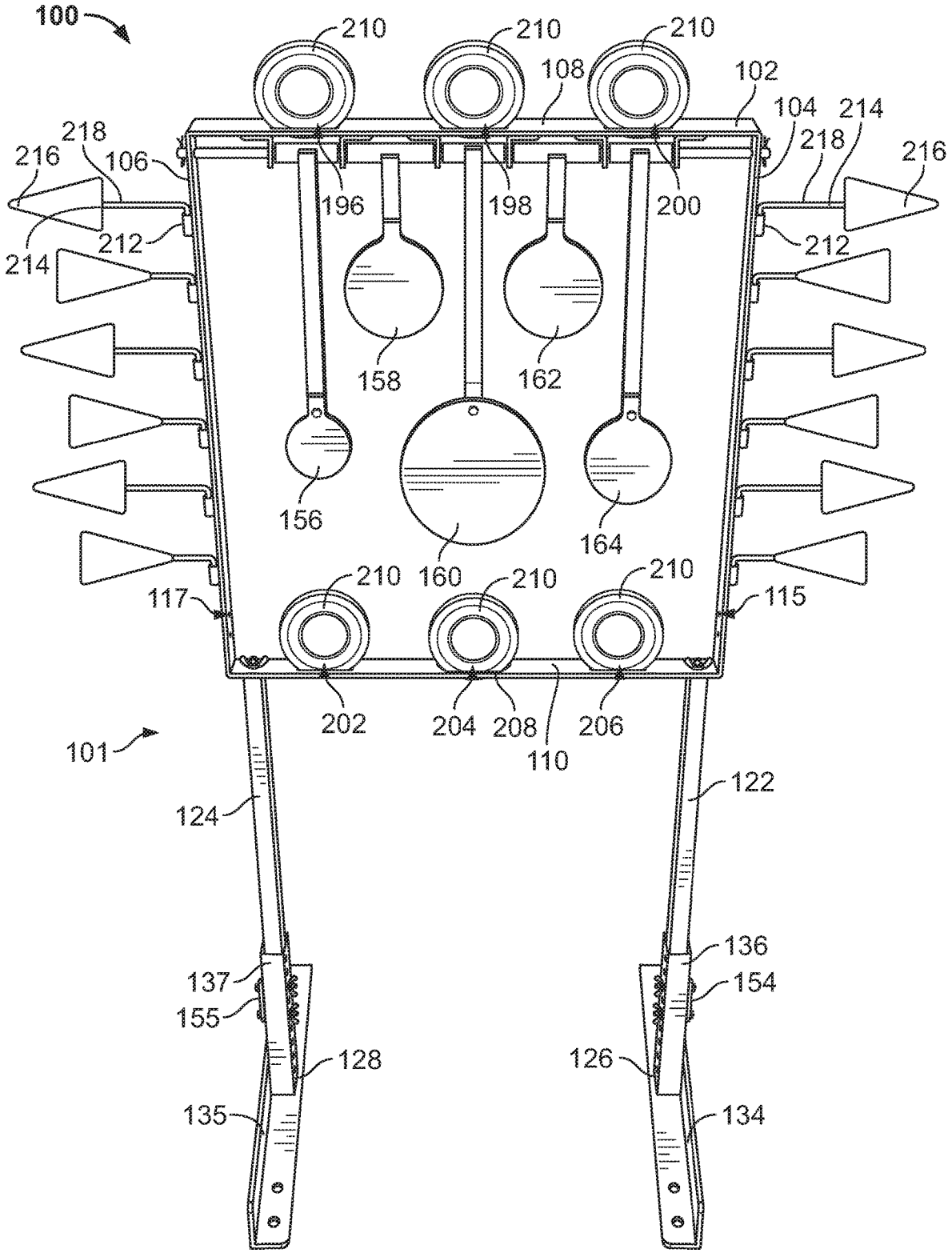
FIG. 3 is a perspective view of the target assembly of FIG. 1 showing additional targets added to the target assembly.

As shown in FIG. 3, each slot 196, 198, 200, 202, 204, 206 is sized and shaped to receive a clay target 210. The clay targets 210 may be standard clay targets included as a component of the target assembly 100 or obtained separately therefrom. Each slot 196, 198, 200, 202, 204, 206 is configured to receive a bottom portion of a circular clay target 210 and support the clay target 210 in an upright position. The grommet 210 prevents the clay target 210 from breaking prior to impact from a bullet or other projectile.

As shown in FIGS. 2 and 3, each side panel 104, 106 includes a plurality of target-holding cylinders 212 coupled thereto. The target-holding cylinders 212 may be referred to as rotating target holders. In any event, each target-holding cylinder 212 is sized and shaped to receive a rotating target 214, as shown in FIG. 3. The rotating targets 214 may be included as a component of the target assembly 100 or obtained separately therefrom. Each rotating target 214 includes a plate 216, which is for example, a pennant-shaped plate. Each plate 216 is coupled to an L-shaped arm 218 including a first rod and a second rod. The first rod is coupled between the plate 216 and the second rod, and the second rod is positioned with the target-holding cylinder 212 and configured to rotate relative thereto. Thus, the rotating target 214 is rotatable relative to the target-holding cylinder 212, especially when contacted by a bullet or other projectile. The target assembly 100 may include a plurality of latches beyond which the second rod of each rotating target 214 is configured to rotate when contacted by a bullet or other projectile. The latch prevents the rotating target 214 from moving forward after the second rod has moved rearward beyond the latch. The rotating target 214 may be lifted and the second arm may be rotated forwardly past the latch to reset the rotating target 214 in a position to be contacted again by a bullet or other projectile.

Figure 4:
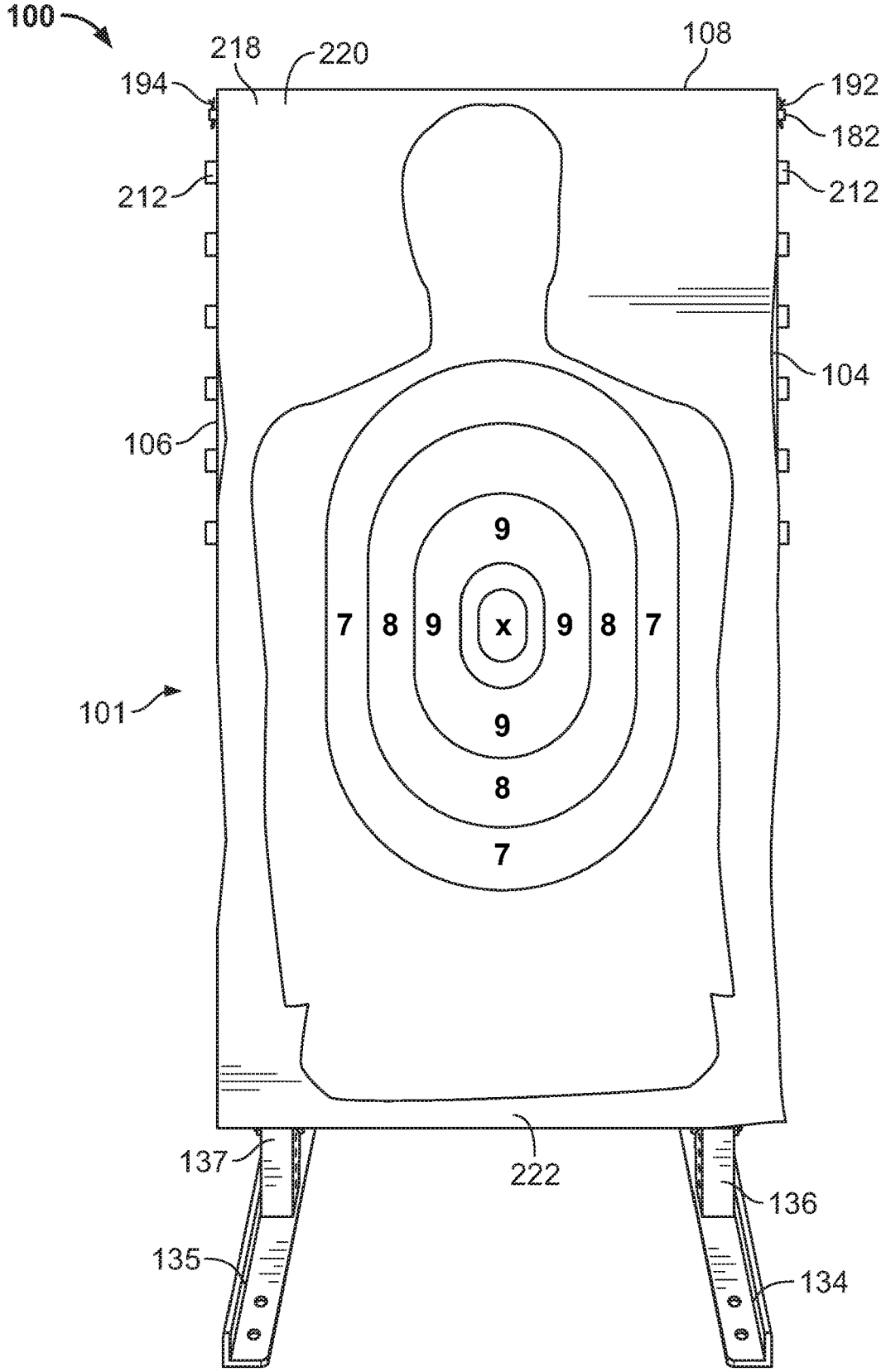
FIG. 4 is a perspective view of the target assembly showing that the target assembly is sized and shaped to support a full-sized silhouette paper target.

As shown in FIG. 4, the target assembly 100 is sized and shaped to support a standard full-sized silhouette paper target 218. The full-sized silhouette paper target 218 may be coupled to the target assembly with a top edge 220 of the paper target 218 being aligned with the top panel 108 of the main frame 102 and a bottom edge 222 being spaced apart from the first and second feet 134, 135.

Figure 6:
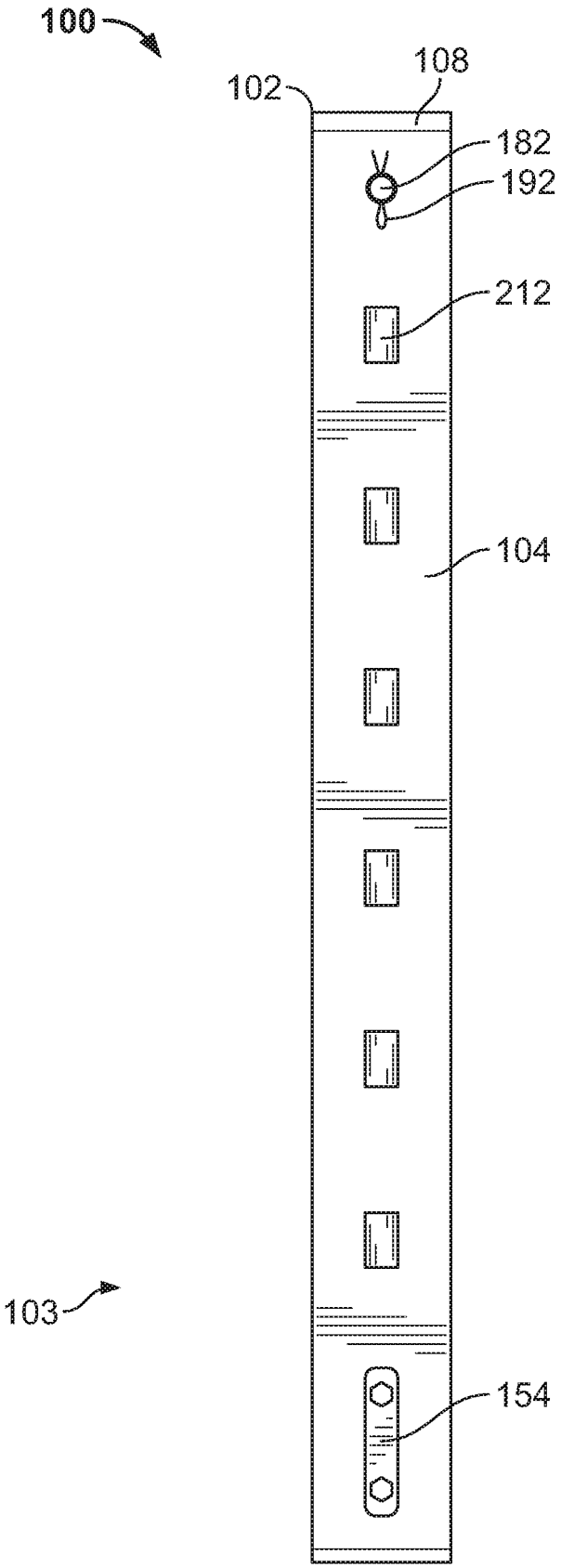
FIG. 6 target is a side view of the target assembly of FIG. 1 showing that a main frame of the target assembly is the widest dimension of the target assembly when the target assembly is in the stowed position.

FIG. 5 shows the target assembly 100 in the stowed position 103. In the stowed position 103, the first and second support legs 122, 124 and the first and second platform bases 126, 128 are each positioned within the main frame 102. In other words, as best shown in FIG. 6, the widest dimension of the target assembly 100, in the stowed position 103, is the side panel 104 of the main frame 102. As such, when the target assembly 100 is viewed in profile in the stowed position 103, the main frame 102 eclipses the components positioned within the main frame 102 including, for example, the first and second support legs 122, 124, the first and second platform bases 126, 128, and the swing target assemblies 156, 158, 160, 162, 164. In other words, the first and second support legs 122, 124, the first and second platform bases 126, 128, and the swing target assemblies 156, 158, 160, 162, 164 are positioned within the footprint of the main frame 102 when the target assembly is in the stowed position 103.

As shown in FIG. 5, the fastener 154 extends through: (i) the pair of apertures 115 formed in the bottom end 114 of the first side panel 104, (ii) two of the series of apertures formed in the second end 125 of the first support leg 122, and (iii) the apertures 146, 148 formed in the front end 140 of the first foot 134. The fastener 154, therefore, forms a three-way coupling between the first platform base 126, the first support leg 122, and the first side panel 104 of the main frame 102. In a similar fashion, the fastener 155 couples together the second platform base 128, the second support leg 124, and the second side panel 106 of the main frame 102.

Referring again to FIG. 5, when the target assembly 100 is in the stowed position 103, the first and second beams 136, 137 prevent or limit rotation of the swinging targets 156, 160, 164 relative to the main frame 102. In some embodiments, the vertical arm 174 of each mount arm 166 is longer than shown in FIG. 5, such that the first and second beams 136, 137 prevent or limit rotation of each swinging target 156, 158, 160, 162, 164. In some embodiments, the first and second platform bases 126, 128 each include an additional beam positioned rearward of the beams 136, 137 and extending upward from the feet 134, 135 respectively. The additional beams may extend substantially parallel or at an angle relative to the beams 136, 137. In any event, the additional beams prevent or limit rotation of the swinging targets 158, 162 relative to the main frame 102.

In use, the target assembly 100 may be moved from the stowed position 103 to the deployed position 101. Specifically, the fasteners 154, 155 may be released from their fastened state to decouple a three-way coupling formed between (i) the first and second support legs 122, 124, (ii) the first and second platform bases 126, 128, and (iii) the first and second side panels 104, 106 of the main frame 102, respectively. The first and second support legs 122, 124 and the first and second platform bases 126, 128 may be removed from their positions within the main frame 102. The first and second platform bases 136, 138 may be positioned on the ground with their beams 136, 137 facing upward. The first ends 123, 127 of the first and second support legs 122, 124 may be fastened to the bottom panel 110 of the main frame 102 with the fasteners 130, 132 respectively. The second ends 125, 129 of the first and second support legs 122, 124 may be coupled to the first and second beams 136, 137 via the fasteners 154, 155 respectively, at which point, the target assembly 100 is in the deployed position 301.

In use, the target assembly 100 may be moved from the deployed position 101 to the stowed position 103. Specifically, the fasteners 154, 155 may be released from their fastened state to decouple the first and second support legs 122, 124 from the beams 136, 137 respectively. The fasteners 130, 132 may be released from their fastened state to decouple the first and second support legs 122, 124 from the bottom panel 110 of the main frame 102. The first and second support legs 122, 124 and the first and second platform bases 126, 128 may be positioned within the main frame 102. The fasteners 154, 155 may be fastened to provide the three-way coupling between (i) the first and second support legs 122, 124, (ii) the first and second platform bases 126, 128, and (iii) the first and second side panels 104, 106 of the main frame 102, respectively. When the three-way coupling is provided, the target assembly 100 is in the stowed position 103.

Figure 7:
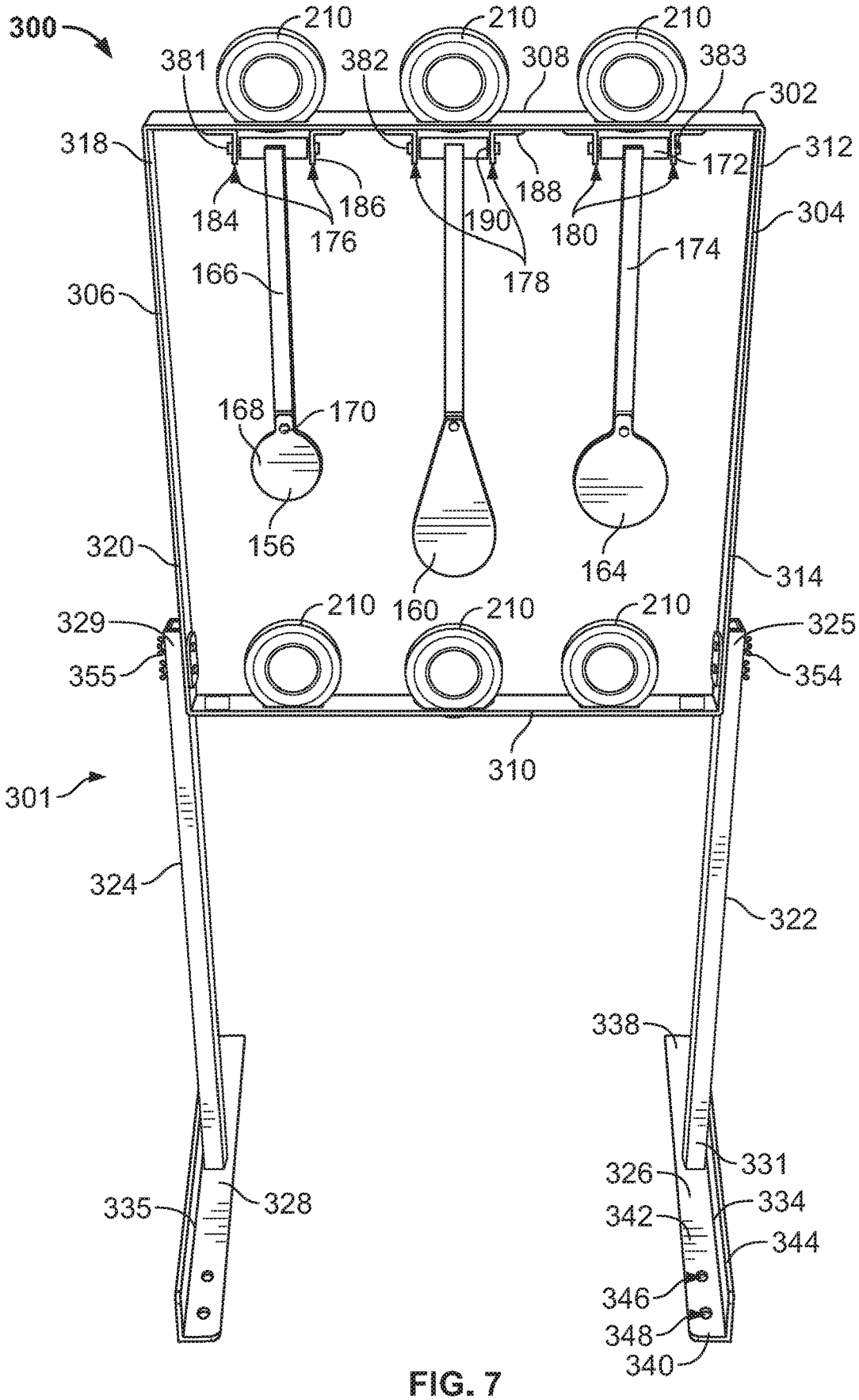
FIG. 7 is a perspective view of another embodiment of a target assembly in a deployed position.
Figure 9:
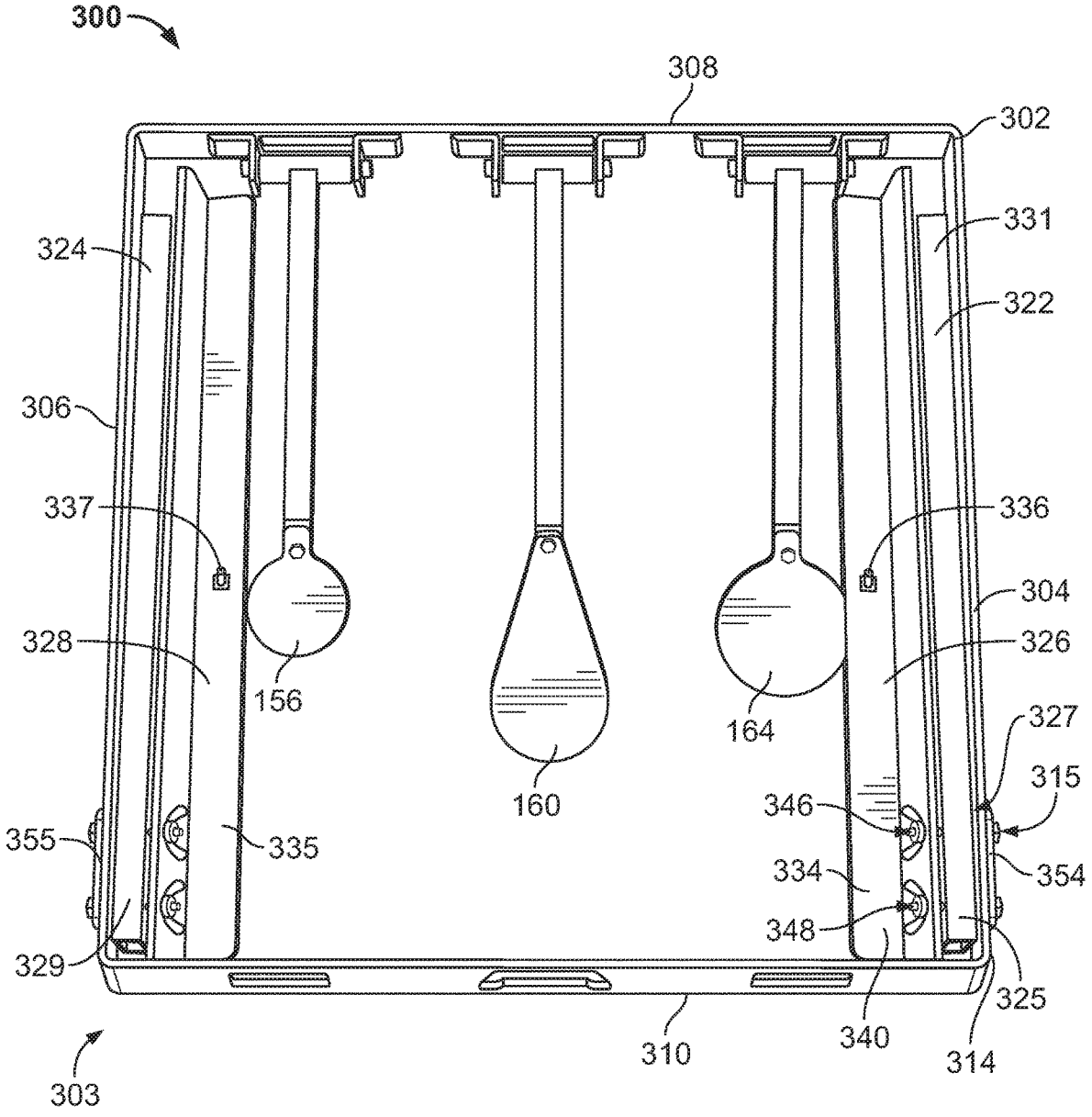
FIG. 9 is a perspective view of the target assembly of FIG. 7 in a stowed position.

FIG. 7 illustrates a target assembly 300, which is movable from a deployed 301 position shown in FIG. 7 to a stowed position 303 shown in FIG. 9. Some components of the target assembly 300 are substantially identical to components of the target assembly 100, and therefore, in some instances, reference numbers are repeated to indicate the commonality.

The target assembly 300 includes a main frame 302 comprising a pair of side panels 304, 306 coupled to a top panel 308 and a bottom panel 310. In the illustrative embodiment, the first side panel 304 includes a top end 312 and a bottom end 314. The second side panel 306 includes a top end 318 and a bottom end 320. The top panel 308 is coupled to the top ends 312, 318 of the first and second side panels 304, 306, and the bottom panel 310 is coupled to the bottom ends 314, 320 of the first and second side panels 304, 306.

Figure 8:
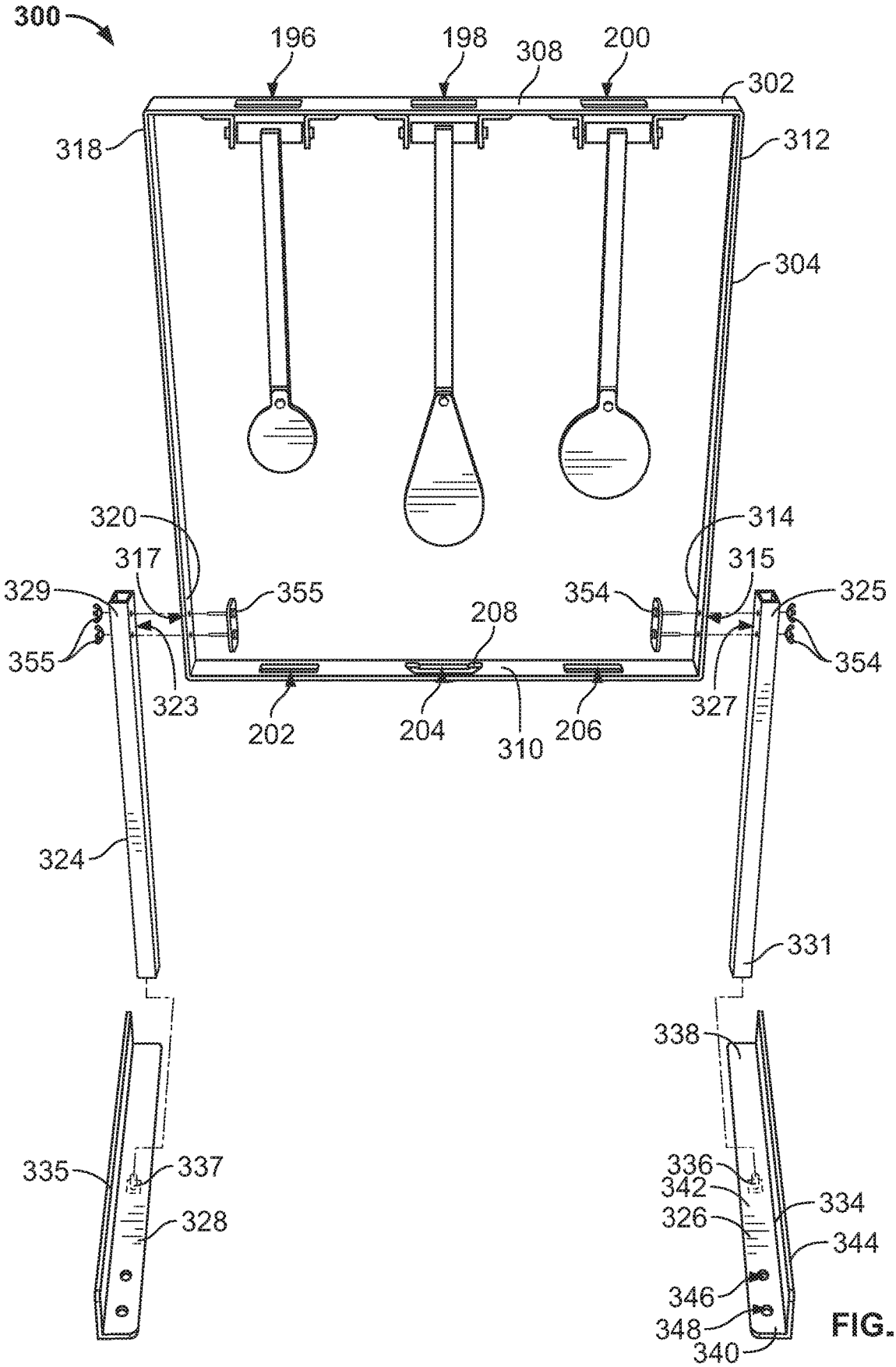
FIG. 8 is an exploded perspective view of the target assembly of FIG. 7.

As best shown in FIG. 8, the bottom ends 314, 320 of the first and second side panels 304, 306 each include at least one aperture 315, 317. In the illustrative embodiment, the at least one apertures 315, 317 each comprise two apertures each configured to receive a dual-fastener fastening mechanism 354 or 355, as will be described in greater detail below.

The target assembly 300 also includes a pair of support legs 322, 324 and a pair of platform bases 326, 328. The first support leg 322 is removably coupled to the bottom 314 of first side panel 304 when the target assembly 300 is in the deployed position 301, as shown in FIG. 7. The second support leg 324 is removably coupled to the bottom end 320 of the second side panel 306 when the target assembly 300 is in the deployed position 301, as shown in FIG. 7. The first support leg 322 includes at least one or, in the illustrative embodiment shown in FIG. 8, a pair of apertures 327 defined in a first end 325 thereof. The second support leg 324 includes at least one or, in the illustrative embodiment shown in FIG. 8, a pair of apertures 323 defined in a first end 329 thereof.

In the illustrative embodiment, the fastener 354 extends through the pairs of apertures 315, 327 to couple the first support leg 322 to the first side panel 304, and the fastener 355 extends through the pairs of apertures 317, 323 to couple the second support leg 324 to the second side panel 306. While in the illustrative embodiment the fasteners 354, 355 are wingnuts and screws threadingly coupled together, it should be appreciated that other fasteners and fastening mechanisms may be used instead. For example, in some embodiments, snap-fit assemblies and hook mechanisms, tabs, and/or cutouts extending from the support legs may be the fasteners used to couple the support legs 322, 324 to the main frame 302.

Referring still to FIG. 7, the first platform base 326 is removably coupled to the first support leg 322, and the second platform base 328 is removably coupled to the second support leg 324 when the target assembly is in the deployed position 301. The first platform base 326 includes a first foot 334 and first beam 336 (see FIG. 8) coupled to the first foot 334, and the second platform base 328 includes a second foot 335 and a second beam 337 (see FIG. 8) coupled to the second foot 335. The first and second beams 336, 337 may also be referred to as first and second stubs 336, 337. It should be appreciated that the first support leg 322 and the second support leg 324 are oriented as mirror images of one another and otherwise identical such that any description of the first support leg 322 applies equally to the second support leg 324 and any mirror-image fasteners coupled thereto. The same is true of the first platform base 326 and the second platform base 328 and any mirror-image fasteners coupled thereto. The same is true of the first panel 304 of the main frame and the second panel 306 of the main frame 302 and any mirror-image fasteners coupled thereto.

The first foot 334 extends from a first end 338 to a second end 340 and is configured to rest on the ground to support the target assembly 300 upright when the target assembly 300 is in the deployed position 301. In the illustrative embodiment, the first foot 334 includes a ground-engaging panel 342 and a support panel 344 coupled to and extending upward from the ground-engaging panel 342. The ground engaging panel 342 includes at least one, and in some instances, two apertures 346, 348 formed in the second end 340 of the foot 334. Stakes or pins (not shown) may be inserted into the apertures 346, 348 to stabilize the target assembly 300 upright in the deployed position 301. The first stub 336 extends upward and substantially perpendicular to the first foot 134 when the target assembly 300 is in the deployed position 301. In the illustrative embodiment, the first stub 336 is welded to the ground-engaging panel 342.

In the illustrative embodiment, the first support leg 322 may be coupled to the first foot 334 by sliding over and surrounding the first stub 336. The first support leg 322 is formed to include a hollow portion defined in a second end 331 thereof configured to receive the first stub 336, as best shown in FIG. 8.

As shown in FIG. 7, the target assembly 300 further includes a plurality of swinging targets including, for example, swinging targets 156, 160, and 164. Each swinging target is configured to rotate or swing forward and rearward relative to the main frame 302 of the target assembly 300. Each swinging target 156, 160, 164 includes the mount arm 166 removably coupled to the plate 168 via the fastener 170. The fastener 170 may be loosened, and the plate 168 may be removed from the mount arm 166. A different plate 168 may be coupled to the mount arm 166 using the same fastener 170. In this way, any plate 168 of the swinging targets 156, 160, 164 is interchangeable with every other plate 168. Similarly, a new plate (not shown), may be coupled to the mount arm 166 to provide a fully customizable target assembly 300.

In the illustrative embodiment, each mount arm 166 includes the horizontal arm 172 and the vertical arm 174. The horizontal arm 172 is a hollow cylinder. The vertical arm 174 extends perpendicular to the horizontal arm 172 and includes a first end coupled to the horizontal arm 172 and a second end coupled to the plate 168. The swinging targets 156, 160, 164 are coupled to the main frame 302 via the plurality of bracket assemblies 176, 178, 180 and a plurality of support rods 381, 382, 383. Each bracket assembly 176, 178, 180 includes the first hanger 184 and the second hanger 186. Each hanger 184, 186 includes the first portion 188 coupled to the top panel 308 of the main frame 302 and the second portion 190 extending from the first portion 188 toward the bottom panel 310 of the main frame 302. The second portion 190 of each hanger 184, 186 includes an aperture formed therein and aligned with the apertures formed in the other second portions 190.

As shown in FIGS. 7 and 8, the support rod 381 may be inserted through the apertures in the bracket assembly 176; the support rod 382 may be inserted through the apertures in the bracket assembly 178; and, the support rod 383 may be inserted through the apertures in the bracket assembly 180. In this arrangement, the swinging targets 156, 160, 164 are supported by the support rods 381, 382, 383 respectively, and the support rods 381, 382, 383 facilitate rotation of the swinging targets 156, 160, 164 relative to the main frame 302. In some embodiments, each swinging target 156, 160, 164 is interchangeable with every other swinging target assembly 156, 160, 164.

Referring now to FIG. 8, the top panel 308 and the bottom panel 310 of the main frame 302 each include the plurality of slots 196, 198, 200, 202, 204, 206. Each slot (and/or the grommet 208 inserted therein) is sized and shaped to receive the clay targets 210 and support the clay target 210 upright.

FIG. 9 shows the target assembly 300 in the stowed position 303. In the stowed position 303, the first and second support legs 322, 324 and the first and second platform bases 326, 328 are each positioned within the main frame 302. In other words, the widest dimension of the target assembly 300, in the stowed position 303, is the side panel 304 of the main frame 302. As such, when the target assembly 300 is viewed in profile in the stowed position 303, the main frame 302 eclipses the components positioned within the main frame 302 including, for example, the first and second support legs 322, 324, the first and second platform bases 326, 328, and the swinging target assemblies 156, 160, 164. In other words, the first and second support legs 322, 324, the first and second platform bases 326, 328, and the swinging target assemblies 156, 160, 164 are positioned within the footprint of the main frame 302 when the target assembly 300 is in the stowed position 303.

As shown in FIG. 9, the fastener 354 extends through: (i) the pair of apertures 315 formed in the bottom end 314 of the first side panel 304, (ii) the pair of apertures 327 formed in the first end 325 of the first support leg 322, and (iii) the apertures 346, 348 formed in the front end 340 of the first foot 334. The fastener 354, therefore, forms a three-way coupling between the first platform base 326, the first support leg 322, and the first side panel 304 of the main frame 302. In a similar fashion, the fastener 355 couples together the second platform base 328, the second support leg 324, and the second side panel 306 of the main frame 302.

It should be appreciated that the target assemblies 100, 300 have been described with different components; however, those components may be interchangeable with one another. For example, the first support leg 122 of the target assembly 100 may include the pair of apertures 327 formed in the first end 325 of the first support leg 322 for coupling the support leg 122 to the side panel 104 (which also may include the pair of apertures 315 formed in the side panel 304). Similarly, the first platform base 326 of the target assembly 300 may include the sleeve 136 for receiving the first support leg 322 and limiting rotation of the target assemblies 156, 160, 164. These two examples of interchangeability are non-limiting examples and are not an exhaustive list of the interchangeable components between the target assemblies 100, 300.

In use, the target assembly 300 may be moved from the stowed position 303 to the deployed position 301. Specifically, the fasteners 354, 355 may be released from their fastened state to decouple a three-way coupling between (i) the first and second support legs 322, 324, (ii) the first and second platform bases 326, 328, and (iii) the first and second side panels 304, 306 of the main frame 302, respectively. The first and second support legs 322, 324 and the first and second platform bases 326, 328 may be removed from their positions within the main frame 302. The first and second platform bases 326, 328 may be positioned on the ground with their beams 336, 337 facing upward. The first and second support legs 322, 324 may be coupled to the first and second side panels 304, 306 of the main frame 302 with the fasteners 354, 355 respectively. The first and second support legs 322, 324 may be slid over the top of the beams 336, 337 such that the beams 336, 337 are inserted into the hollow portions of the first and second support legs 322, 324, at which point, the target assembly 300 is in the deployed position 301.

In use, the target assembly 300 may be moved from the deployed position 301 to the stowed position 303. Specifically, the first and second support legs 322, 324 may be separated from the beams 336, 337. The fasteners 354, 355 may be released from their fastened state to decouple the first and second support legs 322, 324 from the first and second side panels 304, 306 of the main frame 302. The first and second support legs 322, 324 and the first and second platform bases 326, 328 may be positioned within the main frame 302. The fasteners 354, 355 may be fastened to provide the three-way coupling between (i) the first and second support legs 322, 324, (ii) the first and second platform bases 326, 328, and (iii) the first and second side panels 304, 306 of the main frame 302, respectively. When the three-way coupling is provided, the target assembly 300 is in the stowed position 303.

While exemplary embodiments incorporating the principles of the present disclosure have been disclosed herein, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A target assembly configured to be assembled in a stowed position and in a deployed position comprises:

a main frame including:

a first side panel having a first end and a second end, a second side panel having a first end and a second end, a top panel coupled to the first ends of the first and second side panels, and a bottom panel coupled to the seconds ends of the first and second side panels;

a first support leg and a second support leg each removably coupled to the main frame when the target assembly is in the stowed position and the deployed position;

a first fastener and a second fastener;

a first platform base removably coupled to the first support leg when the target assembly is in the stowed position and the deployed position, the first platform base including:

a first foot extending from a first end to a second end and configured to rest on a ground surface, and a first sleeve coupled to and extending substantially perpendicular to the first foot;

a second platform base removably coupled to the second support leg when the target assembly is in the stowed position and the deployed position, the second platform base including:

a second foot extending from a first end to a second end and configured to rest on a ground surface, and a second sleeve coupled to and extending substantially perpendicular to the second foot;

wherein: (i) in the stowed position the first support leg, second support leg, first platform base, and second platform base are positioned within the main frame, and (ii) in the deployed position the first support leg, second support leg, first platform base, and second platform base are positioned outside the main frame;

wherein: (i) in the stowed position the first support leg is removably coupled to the first side panel of the main frame and the second support leg is removably coupled to the second side panel of the main frame, and (ii) in the deployed position the first and second support legs are each removably coupled to the bottom panel of the main frame;

wherein: (i) in the stowed position the first support leg is removably coupled to the first foot of the first platform base, and (ii) in the deployed position the first support leg is removably coupled to the first sleeve of the first platform base;

wherein: (i) in the stowed position the second support leg is removably coupled to the second foot of the second platform base, and (ii) in the deployed position the second support leg is removably coupled to the second sleeve of the second platform base;

wherein (i) the first support leg includes a first end and a second end, (ii) the first end of the first support leg includes a first aperture extending therethrough, (iii) the first fastener extends through the first aperture to removably couple the first support leg to the first foot when the target assembly is in the stowed position, and (iv) the first fastener extends through the first aperture to removably couple the first support leg to the first sleeve when the target assembly is in the deployed position; and wherein (i) the second support leg includes a first end and a second end, (ii) the first end of the second support leg includes a second aperture extending therethrough, (iii) the second fastener extends through the second aperture to removably couple the second support leg to the second foot when the target assembly is in the stowed position, and (iv) the second fastener extends through the second aperture to removably couple the second support leg to the second sleeve when the target assembly is in the deployed position.

2. The target assembly of claim 1, wherein in the stowed position the first fastener extends through and removably couples the first side panel, the first support leg, and first platform base; and wherein in the stowed position the second fastener extends through and removably couples the second side panel, the second support leg, and second platform base.

3. A target assembly configured to be assembled in a stowed position and a deployed position comprises:

a main frame including:

a first side panel having a first end and a second end, a second side panel having a first end and a second end, a top panel coupled to the first ends of the first and second side panels, and a bottom panel coupled to the seconds ends of the first and second side panels;

a first support leg and a second support leg each removably coupled to the main frame when the target assembly is in the stowed position and the deployed position;

a first fastener and a second fastener;

a first platform base removably coupled to the first support leg when the target assembly is in the stowed position and the deployed position, the first platform base including:

a first foot extending from a first end to a second end, and a first beam coupled to the first foot;

a second platform base removably coupled to the second support leg when the target assembly is in the stowed position and the deployed position, the second platform base including:

a second foot extending from a first end to a second end, and a second beam coupled to the second foot;

wherein in the stowed position the first support leg, second support leg, first platform base, and second platform base are positioned within the main frame;

wherein (i) the first support leg includes a first end and a second end, (ii) the first end of the first support leg includes a first aperture extending therethrough, (iii) the first fastener extends through the first aperture to removably couple the first support leg to the first foot when the target assembly is in the stowed position, and (iv) the first fastener extends through the first aperture to removably couple the first support leg to the first beam when the target assembly is in the deployed position; and wherein (i) the second support leg includes a first end and a second end, (ii) the first end of the second support leg includes a second aperture extending therethrough, (iii) the second fastener extends through the second aperture to removably couple the second support leg to the second foot when the target assembly is in the stowed position, and (iv) the second fastener extends through the second aperture to removably couple the second support leg to the second beam when the target assembly is in the deployed position.

4. The target assembly of claim 3, wherein in the deployed position the first support leg, second support leg, first platform base, and second platform base are positioned outside the main frame.

5. The target assembly of claim 3, wherein: (i) in the stowed position the first support leg is removably coupled to the first side panel of the main frame and the second support leg is removably coupled to the second side panel of the main frame, and (ii) in the deployed position the first and second support legs are each removably coupled to the bottom panel of the main frame.

6. The target assembly of claim 3, wherein in the stowed position the first fastener removably couples the first support leg and first platform base to the main frame, and wherein in the stowed position the second fastener removably couples the second support leg and second platform base to the main frame.

7. The target assembly of claim 3, further comprising:

a bracket assembly including a first hanger and a second hanger each coupled to and extending downward from the top panel;

a support rod supported above the ground by the first and second hangers; and a swinging target assembly including a mount arm coupled to the support rod and a plate coupled to the mount arm;

wherein the swinging target assembly is rotatable relative to the main frame.

8. The target assembly of claim 7, wherein when the target assembly is in the stowed position at least one of the first beam and the second beam limits rotation of the swinging target assembly.

9. The target assembly of claim 7, further comprising a clay target;

wherein the top panel includes a slot sized to receive the clay target and support the clay target in an upright position.

10. The target assembly of claim 9, wherein the slot is defined between the first hanger and the second hanger.

11. The target assembly of claim 7, wherein the bracket assembly is a first bracket assembly of a plurality of bracket assemblies;

wherein the swinging target assembly is a first swinging target assembly of a plurality of swinging target assemblies;

wherein the first swinging target assembly is positioned between the first and second hanger of the first bracket assembly; and wherein a second swinging target assembly of the plurality of swinging target assemblies is positioned between the second hanger of the first bracket assembly and a first hanger of a second bracket assembly of the plurality of bracket assemblies.

12. The target assembly of claim 11, further comprising a plurality of clay targets;

wherein the top panel includes a plurality of slots each defined between the first and second hangers of different bracket assemblies included in the plurality of bracket assemblies; and wherein each of the plurality slots is sized to receive and support one of the plurality of clay targets in an upright position.

13. The target platform assembly of claim 12, wherein the bottom panel includes a plurality of slots each sized to receive a clay target and support the clay target in an upright position; and wherein the plurality of slots defined in the bottom panel are aligned with the plurality of slots defined in the top panel.

14. The target assembly of claim 3, wherein the first and second beams each include a plurality of apertures; and wherein the first and second fasteners are configured to be inserted in various apertures of the plurality of apertures to adjust the height of the main frame when the target assembly is in the deployed position.

15. The target assembly of claim 3, wherein the first beam includes a third aperture configured to receive the first fastener and the second beam includes a fourth aperture configured to receive the second fastener when the target assembly is in the deployed position; and wherein the first side panel includes a fifth aperture configured to receive the first fastener and the second side panel includes a sixth aperture configured to receive the second fastener when the target assembly is in the stowed position.

16. The target assembly of claim 3, further comprising:

a plurality of target-holding cylinders each coupled to the first or second side panel of the main frame; and a plurality of rotating targets each rotatably coupled to one of the plurality of target-holding cylinders.

17. A method of moving a target assembly between a stowed position and a deployed position comprising:

positioning a platform base of the target assembly on a ground surface;

coupling a first end of a support leg to a main frame of the target assembly and coupling a second end of the support leg to the platform base to move the target assembly to the deployed position, wherein the main frame includes:

a first side panel having a first end and a second end, a second side panel having a first end and a second end, a top panel coupled to the first ends of the first and second side panels, and a bottom panel coupled to the seconds ends of the first and second side panels;

removing a first fastener from an aperture formed in the support leg to decouple the support leg from the platform base;

removing a second fastener from the support leg to decouple the support leg from the main frame;

positioning the platform base and the support leg within the main fame;

inserting the first fastener into: (i) an aperture formed in the main frame, (ii) the aperture formed in the support leg, and (iii) an aperture formed in the platform base to provide a three way coupling between the main frame, the support leg, and the platform base when the target assembly is in the stowed position.

* * * * *